US010262643B1

(12) United States Patent
Kinter

(10) Patent No.: US 10,262,643 B1
(45) Date of Patent: Apr. 16, 2019

(54) MIDI MAPPING SYSTEM AND PROCESS FOR MULTIPLE CHORD AND ARPEGGIO TRIGGERING

(71) Applicant: Zachary Charles Kinter, Sacramento, CA (US)

(72) Inventor: Zachary Charles Kinter, Sacramento, CA (US)

( * ) Notice: Subject to any disclaimer, the term of this patent is extended or adjusted under 35 U.S.C. 154(b) by 0 days.

(21) Appl. No.: 16/059,875

(22) Filed: Aug. 9, 2018

Related U.S. Application Data

(60) Provisional application No. 62/542,956, filed on Aug. 9, 2017.

(51) Int. Cl.

| | |
|---|---|
| ***G10H 1/28*** | (2006.01) |
| ***G10H 1/00*** | (2006.01) |
| ***G10H 1/38*** | (2006.01) |
| ***G10H 5/06*** | (2006.01) |

(52) U.S. Cl.
CPC ..... *G10H 1/28* (2013.01); *G10H 1/0066* (2013.01); *G10H 1/386* (2013.01); *G10H 5/06* (2013.01); *G10H 2210/105* (2013.01); *G10H 2210/185* (2013.01); *G10H 2220/036* (2013.01); *G10H 2220/251* (2013.01)

(58) Field of Classification Search
CPC ..... G10H 1/28; G10H 5/06; G10H 1/386; G10H 1/0066; G10H 2220/251; G10H 2210/105; G10H 2220/036; G10H 2210/185
USPC ..... 84/638, 716
See application file for complete search history.

(56) References Cited

U.S. PATENT DOCUMENTS

| | | | | |
|---|---|---|---|---|
| 6,448,486 | B1 * | 9/2002 | Shinsky | G10H 1/0025 84/613 |
| 9,105,260 | B1 * | 8/2015 | Helms | G10H 1/386 |
| 2005/0016366 | A1 * | 1/2005 | Ito | G10H 1/28 84/716 |
| 2008/0072744 | A1 * | 3/2008 | Ito | G10H 1/28 84/638 |
| 2008/0072745 | A1 * | 3/2008 | Ito | G10H 1/28 84/638 |
| 2008/0127813 | A1 * | 6/2008 | Ito | G10H 1/28 84/638 |
| 2015/0013532 | A1 * | 1/2015 | Adam | G10H 1/28 84/638 |

* cited by examiner

*Primary Examiner* — Jeffrey Donels
(74) *Attorney, Agent, or Firm* — Plager Schack LLP; Mark H. Plager; Stephen Hallberg

(57) ABSTRACT

Systems and processes that use MIDI mapping technology for multiple chord and arpeggio triggering are disclosed, including a multiple chord and arpeggio triggering MIDI mapping system and process that assigns, selects, and records chord and multi-arpeggio functions into a digital audio workstation (DAW) host program or an internalized sequencer and a two-phase multiple chord and time-delayed arpeggio triggering MIDI mapping process for recording a chord progression and enabling multi-arpeggio functions of the chords in the chord progression to be worked on at any time-delayed instance after recording the chord progression. The system divides output from a MIDI controller into chord generators and arpeggiators to allow users to define full chords with a single key selection, while also making immediate or time-delayed single key selections for different arpeggios.

11 Claims, 7 Drawing Sheets

MIDI MAPPING SYSTEM AND PROCESS FOR MULTIPLE CHORD AND ARPEGGIO TRIGGERING

CLAIM OF BENEFIT TO PRIOR APPLICATION

This application claims benefit to U.S. Provisional Patent Application 62/542,956, entitled "MIDI mapping technology for multiple chord and arpeggio triggering," filed Aug. 9, 2017. The U.S. Provisional Patent Application 62/542,956 is incorporated herein by reference.

BACKGROUND

Embodiments of the invention described in this specification relate generally to chord mapping to arpeggios, and more particularly, to a multiple chord and arpeggio triggering MIDI mapping system, a multiple chord and arpeggio triggering MIDI mapping process, and a two-phase multiple chord and arpeggio triggering MIDI mapping process.

Current music production software technology provides Arpeggiator solutions on a one dimensional level. There are currently no solutions that provide artists with the ability to program and play different/multiple arpeggios of selected chords.

Current solutions do not allow for musicians to alter between arpeggios of a single chord, thus limiting their creative potential.

Therefore, what is needed is a way to allow users to easily program and play different/multiple arpeggios of selected chords either immediately or at any later time.

BRIEF DESCRIPTION

Novel systems and processes that use MIDI mapping technology for multiple chord and arpeggio triggering are disclosed. In some embodiments, a multiple chord and arpeggio triggering MIDI mapping system is provided to assign, select, and record chord and multi-arpeggio functions into a digital audio workstation (DAW) host program or an internalized sequencer. In some embodiments, a multiple chord and arpeggio triggering MIDI mapping process is provided for triggering a plurality of selectable and configurable arpeggios of a particular chord in a multi-arpeggio section of a keyboard by selection of a MIDI keyboard key that is mapped to the particular chord in a chord generator section of the keyboard. In some embodiments, a two-phase multiple chord and arpeggio triggering MIDI mapping process is provided for recording a chord progression and enabling multi-arpeggio functions of the chords in the chord progression to be worked on at any time-delayed instance after recording the chord progression.

In some embodiments, the multiple chord and arpeggio triggering MIDI mapping system divides output from a MIDI keyboard into multiple functions, including chord generators and arpeggiators. In some embodiments, the multiple chord and arpeggio triggering MIDI mapping system divides the output from any tone triggering device that provides information to a sampler or a synthesizer. Thus, the multiple chord and arpeggio triggering MIDI mapping system is not limited to a MIDI keyboard only, but is able to work with any tone triggering device. In this way, users will be able to play and define full chords with a single key selection, while also playing different arpeggios of the selected chord with single key selections.

In some embodiments, the multiple chord and arpeggio triggering MIDI mapping system is implemented as a multiple chord and arpeggio triggering MIDI mapping software application that a user operates to assign, select, and record chord and multi-arpeggio functions into the DAW host program or an internalized sequencer.

In some embodiments, the multiple chord and arpeggio triggering MIDI mapping process assigns chord and multi-arpeggio functions of the multiple chord and arpeggio triggering MIDI mapping software application to the DAW host program or the internalized sequencer to allow a user to select a chord and trigger different unique arpeggios of the selected chord for user selection and configuration to create a palette of different patterns to record directly into the DAW host program or the internalized sequencer.

In some embodiments, the two-phase multiple chord and arpeggio triggering MIDI mapping process comprises (i) recording a chord progression based on MIDI data from user selections of chord-mapped keys of a MIDI controller and (ii) enabling multi-arpeggio functions of the chords in the chord progression to be triggered, changed, adapted, and otherwise worked on via user selections of arpeggio-mapped keys in the multi-arpeggio section of the MIDI controller at any time-delayed instance, moment, or period after recording the chord progression. In some embodiments, recording the chord progression comprises receiving user selections of chords from the chord generator section of the physical MIDI controller, organizing the chord selections in order as received from the physical MIDI controller, and recording the organized chord selections as a chord progression in the multiple chord and arpeggio triggering MIDI mapping software application. In some embodiments, enabling multi-arpeggio functions at any time-delayed instance after recording the chord progression allows the user to select a chord in the chord progression and trigger and configure different unique arpeggios of the selected chord to add to the palette of different patterns to record directly into the DAW host program or the internalized sequencer of the multiple chord and arpeggio triggering MIDI mapping software application.

The preceding Summary is intended to serve as a brief introduction to some embodiments of the invention. It is not meant to be an introduction or overview of all inventive subject matter disclosed in this specification. The Detailed Description that follows and the Drawings that are referred to in the Detailed Description will further describe the embodiments described in the Summary as well as other embodiments. Accordingly, to understand all the embodiments described by this document, a full review of the Summary, Detailed Description, and Drawings is needed. Moreover, the claimed subject matters are not to be limited by the illustrative details in the Summary, Detailed Description, and Drawings, but rather are to be defined by the appended claims, because the claimed subject matter can be embodied in other specific forms without departing from the spirit of the subject matter.

BRIEF DESCRIPTION OF THE DRAWINGS

Having described the invention in general terms, reference is now made to the accompanying drawings, which are not necessarily drawn to scale, and wherein.

DETAILED DESCRIPTION

Figure 1:
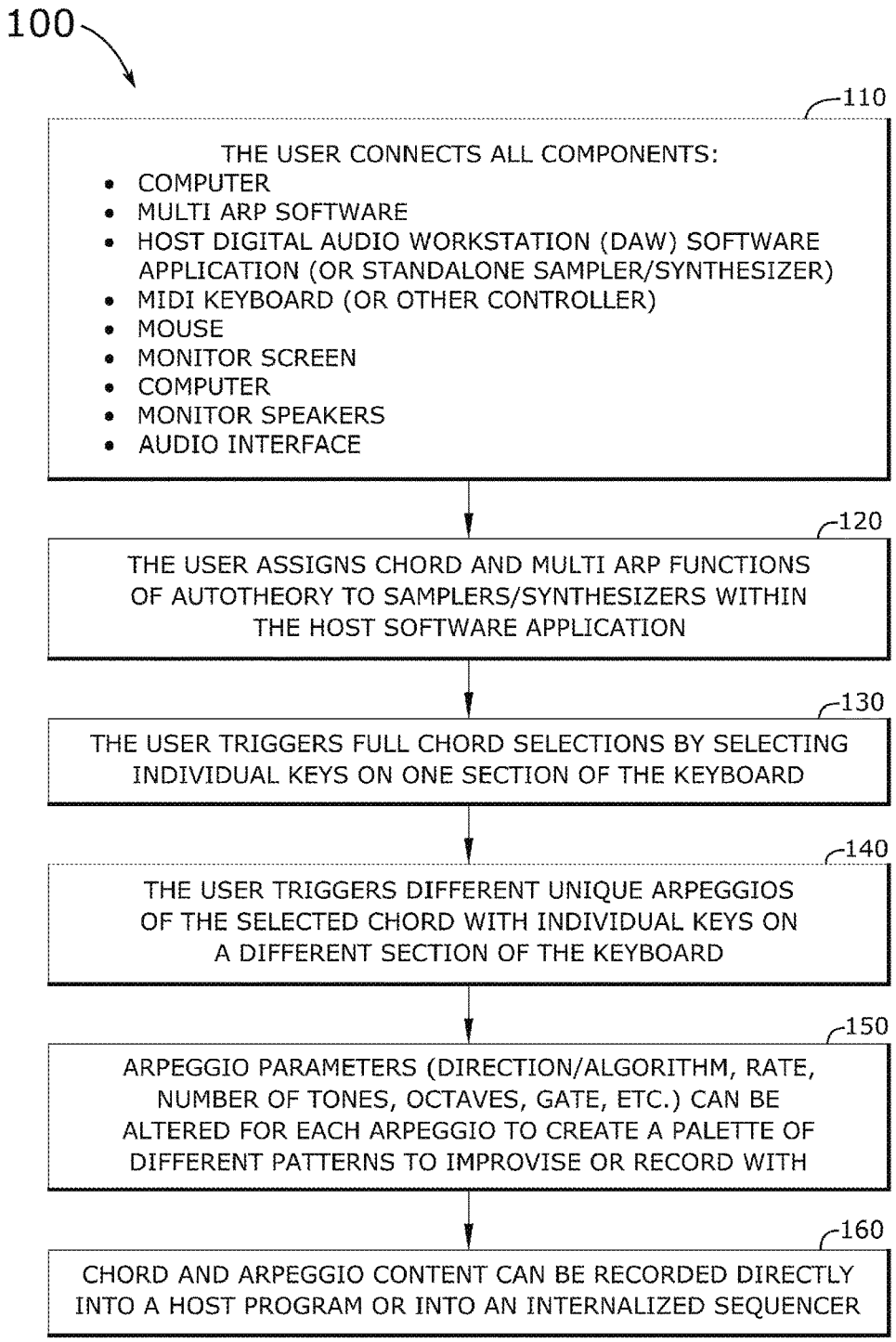
FIG. 1 conceptually illustrates a MIDI mapping process for multiple chord and arpeggio triggering in some embodiments.

In the following detailed description of the invention, numerous details, examples, and embodiments of the invention are described. However, it will be clear and apparent to one skilled in the art that the invention is not limited to the embodiments set forth and that the invention can be adapted for any of several applications.

Some embodiments of the invention include a novel systems and processes that use MIDI mapping technology for multiple chord and arpeggio triggering are disclosed. In some embodiments, a multiple chord and arpeggio triggering MIDI mapping system is provided to assign, select, and record chord and multi-arpeggio functions into a digital audio workstation (DAW) host program or an internalized sequencer. In some embodiments, a multiple chord and arpeggio triggering MIDI mapping process is provided for triggering a plurality of selectable and configurable arpeggios of a particular chord in a multi-arpeggio section of a keyboard by selection of a MIDI keyboard key that is mapped to the particular chord in a chord generator section of the keyboard. In some embodiments, a two-phase multiple chord and arpeggio triggering MIDI mapping process is provided for recording a chord progression and enabling multi-arpeggio functions of the chords in the chord progression to be worked on at any time-delayed instance after recording the chord progression.

In some embodiments, the multiple chord and arpeggio triggering MIDI mapping system divides output from a MIDI keyboard into multiple functions, including chord generators and arpeggiators. In some embodiments, the multiple chord and arpeggio triggering MIDI mapping system divides the output from any tone triggering device that provides information to a sampler or a synthesizer. Thus, the multiple chord and arpeggio triggering MIDI mapping system is not limited to a MIDI keyboard only, but is able to work with any tone triggering device. In this way, users will be able to play and define full chords with a single key selection, while also playing different arpeggios of the selected chord with single key selections.

In some embodiments, the multiple chord and arpeggio triggering MIDI mapping system is implemented as a multiple chord and arpeggio triggering MIDI mapping software application that a user operates to assign, select, and record chord and multi-arpeggio functions into the DAW host program or an internalized sequencer.

In some embodiments, the multiple chord and arpeggio triggering MIDI mapping process assigns chord and multi-arpeggio functions of the multiple chord and arpeggio triggering MIDI mapping software application to the DAW host program or the internalized sequencer to allow a user to select a chord and trigger different unique arpeggios of the selected chord for user selection and configuration to create a palette of different patterns to record directly into the DAW host program or the internalized sequencer.

In some embodiments, the two-phase multiple chord and arpeggio triggering MIDI mapping process comprises (i) recording a chord progression based on MIDI data from user selections of chord-mapped keys of a MIDI controller and (ii) enabling multi-arpeggio functions of the chords in the chord progression to be triggered, changed, adapted, and otherwise worked on via user selections of arpeggio-mapped keys in the multi-arpeggio section of the MIDI controller at any time-delayed instance after recording the chord progression. For purposes of the two-phase multiple chord and arpeggio triggering MIDI mapping process described in this specification, the term "time-delayed" or "time delay" are intended to mean either an immediate time after recording a chord progression (recording the chord progression based on the user's selections of chord-mapped keys of a MIDI keyboard or controller) or any later time after recording the chord progression. In some embodiments, recording the chord progression comprises receiving user selections of chords from the chord generator section of the physical MIDI controller, organizing the chord selections in order as received from the physical MIDI controller, and recording the organized chord selections as a chord progression in the multiple chord and arpeggio triggering MIDI mapping software application. In some embodiments, enabling multi-arpeggio functions at any time-delayed instance after recording the chord progression allows the user to select a chord in the chord progression and trigger and configure different unique arpeggios of the selected chord to add to the palette of different patterns to record directly into the DAW host program or the internalized sequencer of the multiple chord and arpeggio triggering MIDI mapping software application.

As stated above, current music production software technology provides arpeggiator solutions on a one dimensional level. There are currently no solutions that provide artists with the ability to program and play different/multiple arpeggios of selected chords. Embodiments of the multiple chord and arpeggio triggering MIDI mapping system and process described in this specification solve such problems by providing a two step process in which different chords are defined, as well as different arpeggios of those chords, thereby enabling music creators to instantly trigger different/multiple arpeggios of a given chord in an unlimited manner.

Embodiments of the multiple chord and arpeggio triggering MIDI mapping system and process described in this specification differ from and improve upon currently existing options. In particular, some embodiments differ from existing single-dimensional arpeggiator options by dividing output from a MIDI keyboard (or any other tone triggering device or technology that sends information to a sampler or synthesizer) into multiple functions—chord generators and arpeggiators—such that users will be able to play and define full chords with a single key selection, while also playing different arpeggios of the selected chord with single key selections.

In addition, some embodiments of the multiple chord and arpeggio triggering MIDI mapping system and process described in this specification improve upon the currently existing single-dimensional arpeggiator options because the current options are limited to in their ability to provide arpeggio programming options. Specifically, the existing arpeggiator products only provide tools for programming or configuring a single arpeggio (by way of arpeggio settings, such as algorithm, rate, tone, gate, octave, etc.) into which different chords can be played by way of a single step. In contrast, the multiple chord and arpeggio triggering MIDI mapping system and process described in this specification allows users to easily program (or configure arpeggio parameter settings) and play different and/or multiple arpeggios for each chord as selected.

Furthermore, some embodiments of the two phase two-phase multiple chord and arpeggio triggering MIDI mapping process improve upon existing options by allowing for chord progression recording and time-delayed arpeggiator operations and work. Specifically, while the existing arpeggiator products may allow a user to select chords and different arpeggios of those chords, the existing arpeggiator products are limited in that they do not provide a way for users to record a chord progression and then select the arpeggios of the previously recorded chord progression in any immediate or time-delayed manner. In contrast, the two phase two-phase multiple chord and arpeggio triggering MIDI mapping process of the present disclosure allows the user to record a chord progression and then select and work with arpeggios of the recorded chord progression either immediately or at any time-delayed moment after recording.

The multiple chord and arpeggio triggering MIDI mapping system of the present disclosure may be comprised of the following elements. This list of possible constituent elements is intended to be exemplary only and it is not intended that this list be used to limit the multiple chord and arpeggio triggering MIDI mapping system of the present application to just these elements. Persons having ordinary skill in the art relevant to the present disclosure may understand there to be equivalent elements that may be substituted within the present disclosure without changing the essential function or operation of the multiple chord and arpeggio triggering MIDI mapping system.

1. MIDI controller (tonal input from a physical tonal device, e.g., a MIDI keyboard, or any other tone triggering device or technology that sends information to a sampler or synthesizer).

2. Computer, which receives MIDI information from the physical MIDI controller when a user plays the MIDI controller (e.g., selecting keys from the MIDI keyboard).

3. The multiple chord and arpeggio triggering MIDI mapping software application (the subject software being installed on and stored in form on a persistent computer-readable medium of the computer, and when instantiated or started, loaded into a memory (RAM) unit of the computer, and run on a processor of the computer to execute instructions of the multiple chord and arpeggio triggering MIDI mapping software application at runtime).

4. Digital audio workstation (DAW) host software, to which the multiple chord and arpeggio triggering MIDI mapping software application is linked, embedded, or otherwise in communication with.

5. Computer monitor or other user-perceivable output device

6. Audio speakers capable of playing audio provided by the DAW host software, the physical MIDI controller, or the multiple chord and arpeggio triggering MIDI mapping software application, as well as any other connected tone generating devices or software applications.

7. Computer peripheral devices, including, without limitation and a mouse or cursor controller, an alpha-numerical keyboard (for textual input to the computer).

The various elements of the multiple chord and arpeggio triggering MIDI mapping system of the present disclosure may be related in the following exemplary fashion. It is not intended to limit the scope or nature of the relationships between the various elements and the following examples are presented as illustrative examples only. The MIDI controller (1) is connected to the computer (2). The multiple chord and arpeggio triggering MIDI mapping software application (3) and the DAW host software (4) are both installed on the computer (2) and stored in the persistent computer-readable medium of the computer (2). The computer monitor (5), audio speakers (6) and the peripheral devices (7) are all connected to the computer (2) to control and convey visual and audible information.

The MIDI controller (1) sends tonal MIDI data into the computer (2) to the multiple chord and arpeggio triggering MIDI mapping software application (3) which transforms and reorganizes the tonal MIDI data into chord and arpeggio augmented MIDI data. Transformed and augmented MIDI data is then sent into the DAW host software (4) where it is channeled to individual instruments for playback on the audio speakers (6) or for recording (and saving/storing as an audio file that is capable of repeated playback). Parameters in the multiple chord and arpeggio triggering MIDI mapping software application (3) can be edited by user selection, which may include selection and setting of parameters by mouse (7) or alpha-numeric keyboard alternative selection and setting of parameters via a user interface (UI) of the multiple chord and arpeggio triggering MIDI mapping software application (3), which is visually output onto the computer monitor (5) or other user-perceivable output or display device.

The multiple chord and arpeggio triggering MIDI mapping system of the present disclosure generally works by way of the multiple chord and arpeggio triggering MIDI mapping software application, which receives MIDI data from a MIDI controller and transforms the received MIDI data before sending it into the DAW host software program, where the MIDI data is sent to control different plug-in instruments or is recorded and saved as audio files. In some embodiments, the multiple chord and arpeggio triggering MIDI mapping system defines specific MIDI tone regions on a keyboard by way of the multiple chord and arpeggio triggering MIDI mapping software application. As such, when a user selects keys from one region (a chord region) of the keyboard, the multiple chord and arpeggio triggering MIDI mapping software application applies a full chord effect to the individual key selection. Then when the user selects a key from a different region (arpeggio region) of the keyboard, the multiple chord and arpeggio triggering MIDI mapping software application engages a predefined and editable arpeggio affect. The arpeggio affect is one arpeggio from a plurality of arpeggios associated with a given chord. Thus, arpeggios selected from their specific region are based off of the most recently selected chord from the chord region. For example, arpeggios selected from an arpeggio region defined to include the set of keys on the right side of the keyboard are based off of the most recently selected chord from the chord region defined to include the set of keys on the left side of the keyboard.

Furthermore, all chord and arpeggio MIDI data can be routed to individual instruments within the host DAW software. Thus, while described above as a software solution, this process could also take place within a keyboard.

In general, to use the multiple chord and arpeggio triggering MIDI mapping system, process, and software application of the present disclosure, users select keys from their MIDI controller, understanding that the selection will engage different chords and arpeggios via the multiple chord and arpeggio triggering MIDI mapping software application. In other words, when a user makes a single key selection from a particular section of the keyboard (the chord section or region, whatever keys are defined for that chord section), the key selection engages and defines a chord; and when the user selects a key from a different section of the keyboard (the arpeggio section or region, whatever keys are defined for that arpeggio section), the key from the different section engages an arpeggio of the selected chord. Different arpeggio parameters including, without limitation, algorithm, gate, number of tones, octave range, rate, etc., can be assigned to each key that performs an arpeggio function.

An enhanced visually-perceptible module could be added to aid the aurally impaired user, while enhanced audio cues could be similarly added to aid the visually impaired user. Improvements in audio replay and recording devices will enhance the user experience, as improved audio clarity will allow for enhanced mapping and comparison capabilities.

While MIDI is currently the predominant medium for multi sample (individual samples of each tone from an instrument) based music production and playback, the mechanical processes described above could apply to any form of keyboard/software/sample playback.

More specifically, to use the multiple chord and arpeggio triggering MIDI mapping system and process of the present disclosure, a user turns on their computer, monitor, and speakers, and ensures that their MIDI keyboard is connected. The user would instantiate (launch) the multiple chord and arpeggio triggering MIDI mapping software application and the DAW host software on the computer. Through the multiple chord and arpeggio triggering MIDI mapping software application, the user would define what chords to use. The defined chords would be automatically mapped to a specific region of the keyboard (e.g., the chord region or the chord generator region). The user would also define multiple arpeggios of the selected chords by adjusting or configuring parameters such as algorithm (direction), rate, gate, octave range, number of tones, etc, for each respective arpeggio. After the multiple chord and arpeggio triggering MIDI mapping software application is thus configured, the user could assign the outputs of the multiple chord and arpeggio triggering MIDI mapping software application to individual instruments within the DAW host software. Once assigned, the user could trigger chords and arpeggios from different instruments within the DAW host software by selecting keys from their MIDI controller or qwerty computer keys (or mouse selection of visually output virtual MIDI keyboard with chord and arpeggio regions displayed and available for selection). The chords and arpeggios could be recorded within the DAW host software and then exported as an audio file.

Furthermore, by way of the two-phase multiple chord and arpeggio triggering MIDI mapping process, a user can perform multi-arpeggio recording and sequencing functions in any time-delayed manner, and can do so repeatedly once a chord progression is recorded into the multiple chord and arpeggio triggering MIDI mapping software application. Such time-delayed usage is performed by the user interacting with a physical MIDI keyboard or controller to select chords for a chord progression, which are then recorded into the software for immediate or later access by the user to work on arpeggio configurations to send out to the DAW software application and/or an internal sequencer of the multiple chord and arpeggio triggering MIDI mapping software application. For purposes of the two-phase multiple chord and arpeggio triggering MIDI mapping process described in this specification, the term "time-delayed" or "time delay" are intended to mean either an immediate time after recording a chord progression or any later time after recording the chord progression. Furthermore, when a chord progression is recorded in the multiple chord and arpeggio triggering MIDI mapping software application, the user may at any later time update the chord progression with additional chords added to the chord progression or by removal or one of more chords in the chord progression, and other such changes to the chord progression. Additionally, the user can create and record multiple different chord progressions to use in time-delayed fashion in working with the arpeggios of the chords within such chord progressions. Also, two or more chord progressions can be combined within the multiple chord and arpeggio triggering MIDI mapping software application after being recorded, and can be combined whether or not arpeggio work has been performed and sent out to the DAW software application or internal sequencer of the multiple chord and arpeggio triggering MIDI mapping software application. Similarly, a single recorded chord progression can be split into parts and saved/recorded as separate chord progressions after the original/initial single chord progression is recorded into the multiple chord and arpeggio triggering MIDI mapping software application. Specifically, the two-phase multiple chord and arpeggio triggering MIDI mapping process of some embodiments describes such time-delayed usage in process steps comprising (i) recording a chord progression based on MIDI data from user selections of chord-mapped keys of a MIDI controller and (ii) enabling multi-arpeggio functions of the chords in the chord progression to be triggered, changed, adapted, and otherwise worked on via user selections of arpeggio-mapped keys in the multi-arpeggio section of the MIDI controller at any time-delayed instance after recording the chord progression.

Several more detailed embodiments are described below. Section I describes some MIDI mapping processes for multiple chord and arpeggio triggering. Section II describes detailed examples of using the multiple chord and arpeggio triggering MIDI mapping system. Lastly, Section III describes an electronic system that implements some embodiments of the invention.

I. MIDI Mapping Processes for Multiple Chord and Arpeggio Triggering

By way of example, FIG. 1 conceptually illustrates a MIDI mapping process for multiple chord and arpeggio triggering 100. As shown in this figure, the MIDI mapping process for multiple chord and arpeggio triggering 100 starts with the user connecting (at 110) all components of the multiple chord and arpeggio triggering MIDI mapping system. The components of the multiple chord and arpeggio triggering MIDI mapping system include at least the computer, the multiple chord and arpeggio triggering MIDI mapping software application, the DAW host software program, the MIDI keyboard (or other tonal MIDI controller), the mouse or cursor controlling device, the computer monitor or other visual output device, the audio speakers and audio interface.

Next, the MIDI mapping process for multiple chord and arpeggio triggering 100 continues to the next step (at 120) at which the user assigns chord and multi-arpeggio functions of the multiple chord and arpeggio triggering MIDI mapping software application to samplers/synthesizers within the DAW host software application.

After assigning, the MIDI mapping process for multiple chord and arpeggio triggering 100 continues to the next step (at 130) at which the user selects individual keys on one section (the chord generator section) of the MIDI keyboard, which triggers full chord selections in the multiple chord and arpeggio triggering MIDI mapping software application.

The MIDI mapping process for multiple chord and arpeggio triggering 100 proceeds to the next step (at 140) at which the user triggers different unique arpeggios of the selected chord with individual keys in a different section (multi-arpeggio section) of the MIDI keyboard.

The next step in the MIDI mapping process for multiple chord and arpeggio triggering 100 (at 150) allows the user to select and alter arpeggio parameters to create a palette of different patterns to improvise or record with. Examples of the parameters include, without limitation, direction, algorithm, rate, number of tones, octaves, gate, etc.

The MIDI mapping process for multiple chord and arpeggio triggering 100 proceeds to the final step (at 160) where chord and arpeggio content can be recorded directly into a host program or into an internalized sequencer.

Figure 2:
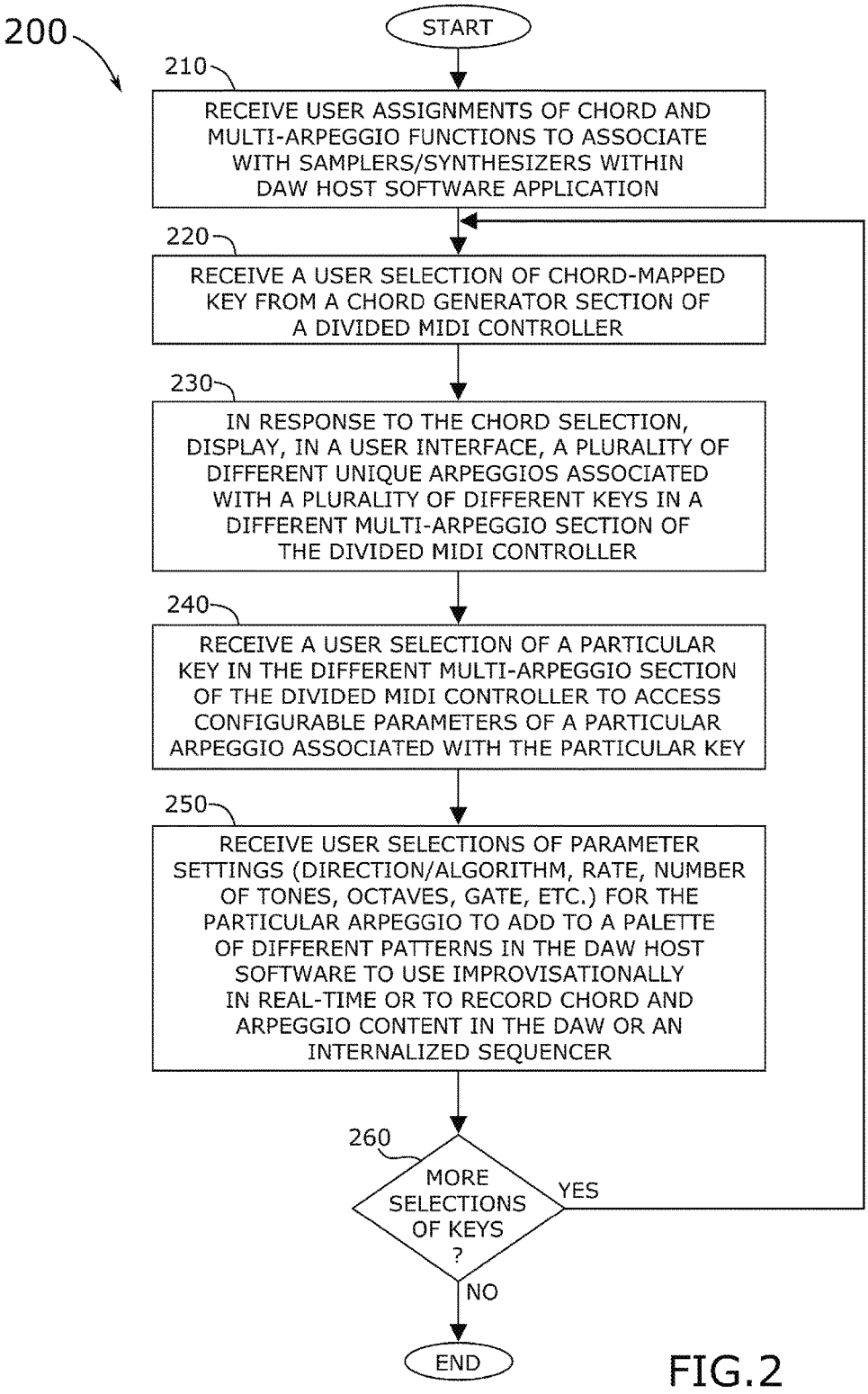
FIG. 2 conceptually illustrates a MIDI mapping process for multiple chord and arpeggio triggering performed by a multiple chord and arpeggio triggering MIDI mapping software application in some embodiments.

Now turning to another example, FIG. 2 conceptually illustrates a MIDI mapping process for multiple chord and arpeggio triggering performed by the multiple chord and arpeggio triggering MIDI mapping software application 200. As shown in this figure, the MIDI mapping process for multiple chord and arpeggio triggering performed by the multiple chord and arpeggio triggering MIDI mapping software application 200

In some embodiments, the MIDI mapping process for multiple chord and arpeggio triggering performed by the multiple chord and arpeggio triggering MIDI mapping software application 200 receives (at 210) user assignments of chord and multi-arpeggio functions to associate with samples and/or synthesizers in the DAW host software application. In some embodiments, the MIDI mapping process for multiple chord and arpeggio triggering performed by the multiple chord and arpeggio triggering MIDI mapping software application 200 then receives (at 220) a user selection of chord-mapped key from a chord generator section of a divided MIDI keyboard/controller. The chord generator section is defined to include a set of keys on the MIDI keyboard/controller, and maybe grouped together, such that half of the MIDI keyboard keys are defined to be part of the chord generator section, while the keys from the other half are defined to be part of a multi-arpeggio section of the MIDI keyboard/controller.

In response to the chord selection (selection of the chord-mapped key from the MIDI keyboard/controller), the MIDI mapping process for multiple chord and arpeggio triggering performed by the multiple chord and arpeggio triggering MIDI mapping software application 200 displays in a user interface (UI) of the multiple chord and arpeggio triggering MIDI mapping software application (at 230) a plurality of different unique arpeggios associated with a plurality of different keys in a different multi-arpeggio section of the divided MIDI keyboard/controller.

In some embodiments, the MIDI mapping process for multiple chord and arpeggio triggering performed by the multiple chord and arpeggio triggering MIDI mapping software application 200 receives (at 240) a user selection of a particular key in the different multi-arpeggio section of the divided MIDI keyboard/controller to access configurable parameters of a particular arpeggio associated with the particular key.

In some embodiments, the MIDI mapping process for multiple chord and arpeggio triggering performed by the multiple chord and arpeggio triggering MIDI mapping software application 200 receives (at 250) user selections of parameter settings for the particular arpeggio to add to a palette of different patterns in the DAW host software to either (or both) use improvisational in real-time or to record chord and arpeggio content in the DAW host software or an internalized sequencer. Examples of arpeggio parameter settings include, without limitation, direction, arpeggio algorithm, rate, number of tones, octaves, gate, range, velocity, etc.

Next, the MIDI mapping process for multiple chord and arpeggio triggering performed by the multiple chord and arpeggio triggering MIDI mapping software application 200 determines (at 260) whether there are more selections of keys to process. When there are more selections of keys, the MIDI mapping process for multiple chord and arpeggio triggering performed by the multiple chord and arpeggio triggering MIDI mapping software application 200 transitions back to the step for receiving (at 220) the user selection of the key and proceeds as described above. On the other hand, when there are no more selections of keys, the MIDI mapping process for multiple chord and arpeggio triggering performed by the multiple chord and arpeggio triggering MIDI mapping software application 200 ends.

Other processes are anticipated in relation to the multiple chord and arpeggio triggering MIDI mapping system. For instance, the two-phase multiple chord and arpeggio triggering MIDI mapping process of some embodiments allows for time-delayed usage of the multiple chord and arpeggio triggering MIDI mapping system by process steps comprising (i) recording a chord progression based on MIDI data from user selections of chord-mapped keys of a MIDI controller and (ii) enabling multi-arpeggio functions of the chords in the chord progression to be triggered, changed, adapted, and otherwise worked on via user selections of arpeggio-mapped keys in the multi-arpeggio section of the MIDI controller at any time-delayed instance after recording the chord progression. In some embodiments, recording the chord progression comprises receiving user selections of chords from the chord generator section of the physical MIDI controller, organizing the chord selections in order as received from the physical MIDI controller, and recording the organized chord selections as a chord progression in the multiple chord and arpeggio triggering MIDI mapping software application. In some embodiments, enabling multi-arpeggio functions at any time-delayed instance after recording the chord progression allows the user to select a chord in the chord progression and trigger and configure different unique arpeggios of the selected chord to add to the palette of different patterns to record directly into the DAW host program or the internalized sequencer of the multiple chord and arpeggio triggering MIDI mapping software application.

Thus, by way of the two-phase multiple chord and arpeggio triggering MIDI mapping process and interaction with the multiple chord and arpeggio triggering MIDI mapping software application, a user can perform multi-arpeggio recording and sequencing functions in any time-delayed manner, and can do so repeatedly once a chord progression is recorded into the multiple chord and arpeggio triggering MIDI mapping software application. Such time-delayed usage is performed by the user interacting with a physical MIDI keyboard or controller to select chords for a chord progression, which are then recorded into the software for immediate or later access by the user to work on arpeggio configurations to send out to the DAW software application and/or an internal sequencer of the multiple chord and arpeggio triggering MIDI mapping software application. Furthermore, when a chord progression is recorded in the multiple chord and arpeggio triggering MIDI mapping software application, the user may at any later time update the chord progression with additional chords added to the chord progression or by removal or one of more chords in the chord progression, and other such changes to the chord progression. Additionally, the user can create and record multiple different chord progressions to use in time-delayed fashion in working with the arpeggios of the chords within such chord progressions. Also, two or more chord progressions can be combined within the multiple chord and arpeggio triggering MIDI mapping software application after being recorded, and can be combined whether or not arpeggio work has been performed and sent out to the DAW software application or internal sequencer of the multiple chord and arpeggio triggering MIDI mapping software application. Moreover, a single recorded chord progression can be split into parts and saved/recorded as separate chord progressions after the original/initial single chord progression is recorded into the multiple chord and arpeggio triggering MIDI mapping software application.

II. Examples of Using the Multiple Chord and Arpeggio Triggering MIDI Mapping System While the processes described above by reference to FIGS. 1 and 2 provide an understanding of certain embodiments of the multiple chord and arpeggio triggering MIDI mapping system and the multiple chord and arpeggio triggering MIDI mapping process, more detailed understanding can be had by examples in which a user interacts with the multiple chord and arpeggio triggering MIDI mapping software application that implements the multiple chord and arpeggio triggering MIDI mapping system.

Figure 3:
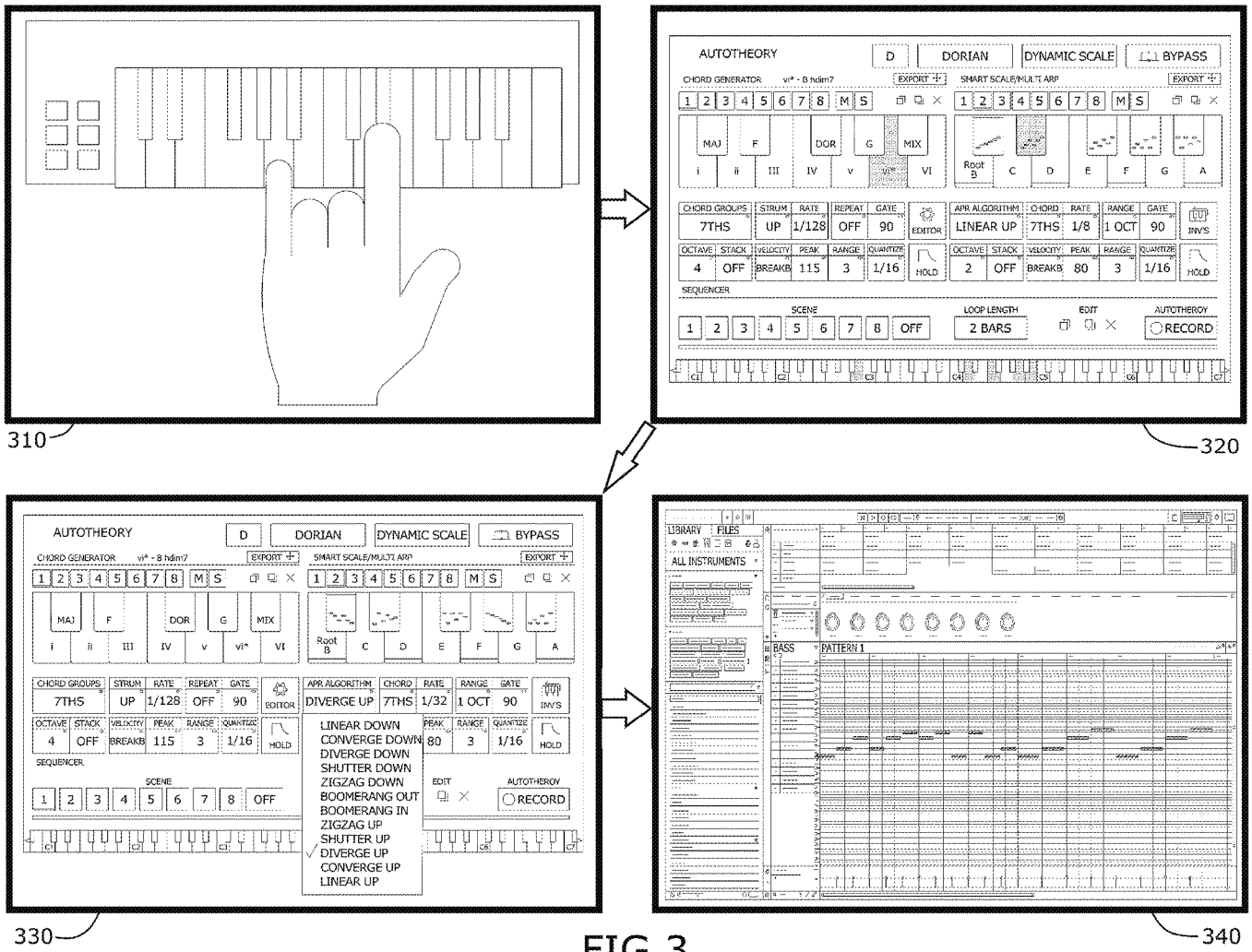
FIG. 3 conceptually illustrates four stages of the MIDI mapping process for multiple chord and arpeggio triggering in some embodiments.

By way of a first example, FIG. 3 conceptually illustrates four stages of the MIDI mapping process for multiple chord and arpeggio triggering. The four stages of the MIDI mapping process for multiple chord and arpeggio triggering include a first stage 310, a second stage 320, a third stage 330, and a fourth stage 340. Each of the four stages are further described by reference to FIGS. 4-7, with description of the first stage 310 enhanced by reference to FIG. 4, the description of the second stage 320 detailed by reference to FIG. 5, the description of the third stage 330 making reference to FIG. 6, and the description of the fourth stage 340 further described by reference to FIG. 7. Thus, in describing the four stages of FIG. 3, references to each of the other figures, namely FIG. 4, FIG. 5, FIG. 6, and FIG. 7, are intermingled within the description of the MIDI mapping process for multiple chord and arpeggio triggering over the four stages.

Turning first to FIG. 3, as shown in this figure, the first stage 310 demonstrates a user making selections of two keys on a MIDI keyboard. In this example, the two keys being selected are already associated with specific sections of the MIDI keyboard that have been previously assigned. For example, the user may have assigned keys on the left side of the MIDI keyboard to be part of the chord generator section and assigned keys on the right side of the MIDI keyboard to be part of the multi-arpeggio section of the MIDI keyboard. In this example, then, the user is selecting one key (by the little finger selection) from the chord generator section and another different key (by the big finger selection) from the multi-arpeggio section of the MIDI keyboard.

Figure 4:
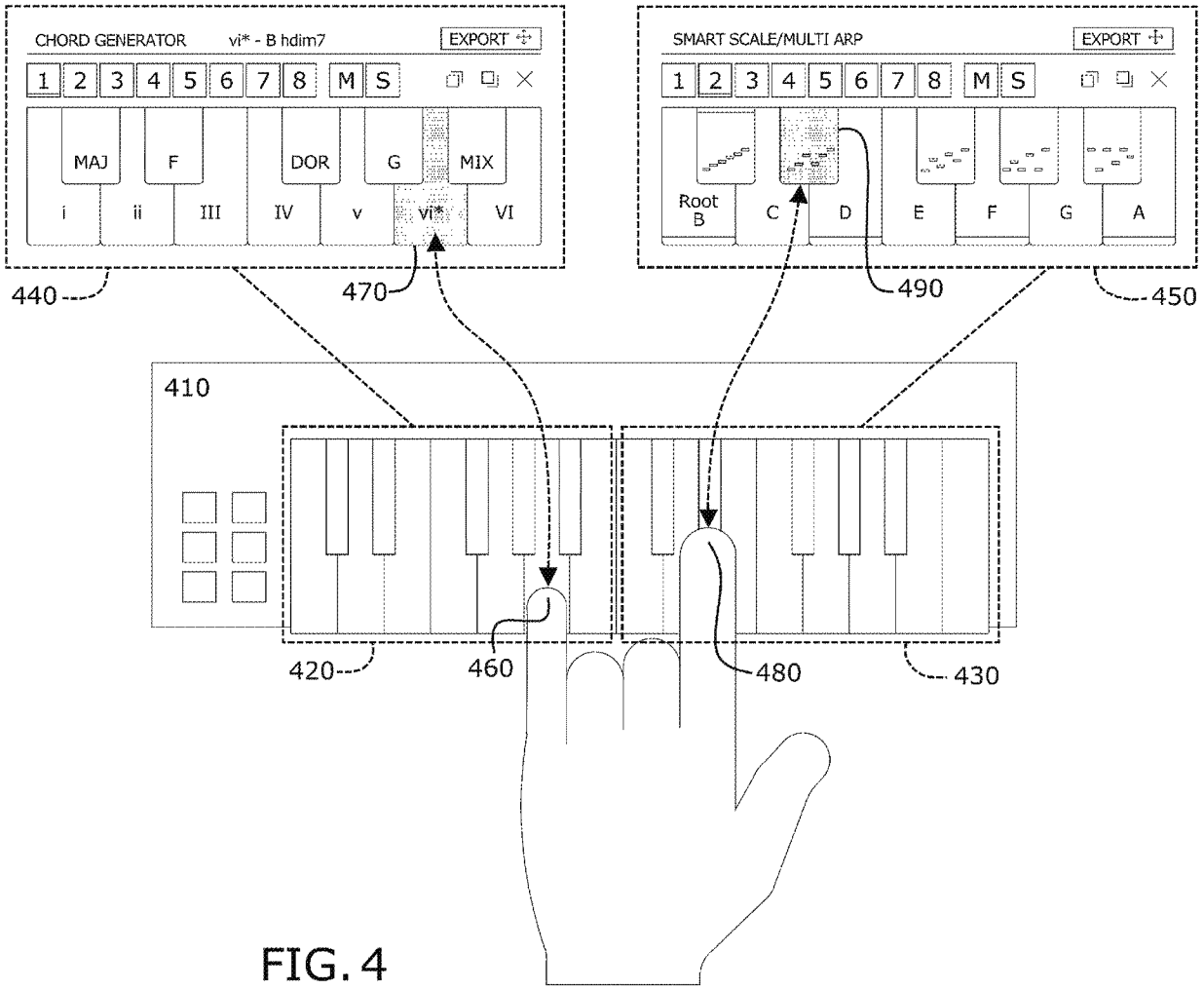
FIG. 4 conceptually illustrates a detailed schematic view of chord selection and arpeggio selection that occurs during the first stage of the MIDI mapping process for multiple chord and arpeggio triggering.

Now referring to FIG. 4, which conceptually illustrates a schematic detailed view of chord selection and arpeggio selection that occurs during the first stage 310 of the MIDI mapping process for multiple chord and arpeggio triggering. In particular, the schematic detailed view in FIG. 4 includes the physical MIDI keyboard 410, a first set of physical keys that are included in a first section 420 of the MIDI keyboard, a second set of physical keys that are included in a second section 430 of the MIDI keyboard 410, a chord generator section 440 that is defined according to the first section 420 of the physical MIDI keyboard 410, a multi-arpeggio section 450 that is defined according to the second section 430 of the physical MIDI keyboard 410, a little finger selection 460 of a key from the first set of physical keys in the first section 420 of the MIDI keyboard 410, a corresponding selection 470 of a particular key in the chord generator section 440, a big finger selection 480 of a key from the second set of physical keys in the second section 430 of the MIDI keyboard of the MIDI keyboard 410, and a corresponding selection 490 of a specific key in the multi-arpeggio section 450.

Next, turning back to FIG. 3, the second stage 320 demonstrates the user interface (UI) of the multiple chord and arpeggio triggering MIDI mapping software application. The UI of the multiple chord and arpeggio triggering MIDI mapping software application shown in the second stage 320 includes keys that have been highlighted in response to the user selections of the two physical keys of the physical MIDI keyboard, as shown in the first stage 310.

Figure 5:
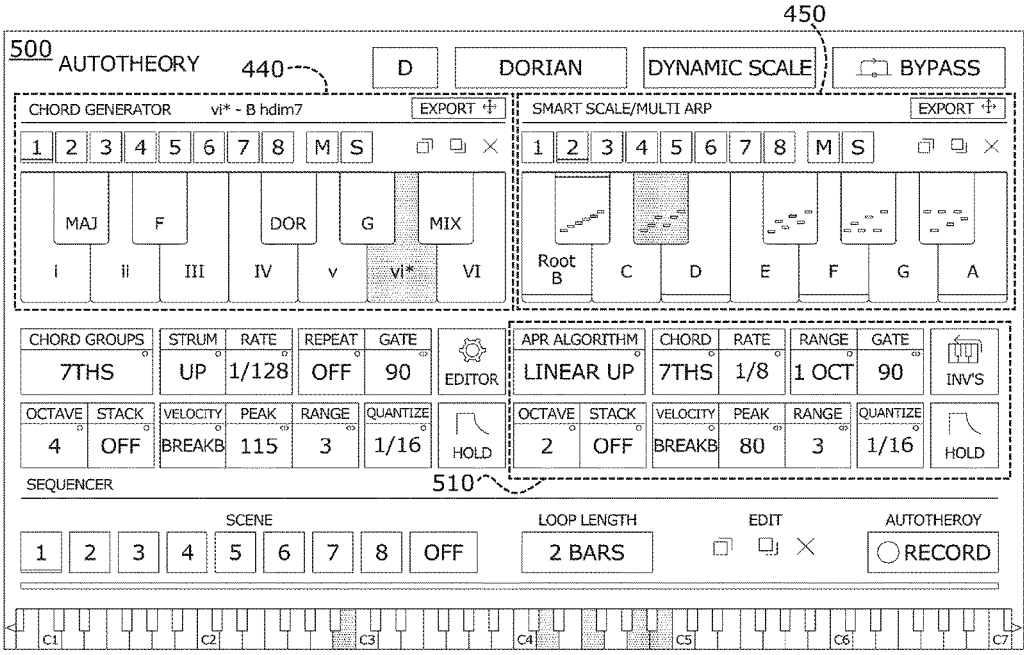
FIG. 5 conceptually illustrates a detailed user interface (UI) of the multiple chord and arpeggio triggering MIDI mapping software application with highlighted selections in response to the user's chord selection and arpeggio selection as shown in the second stage of the MIDI mapping process for multiple chord and arpeggio triggering.
Figure 6:
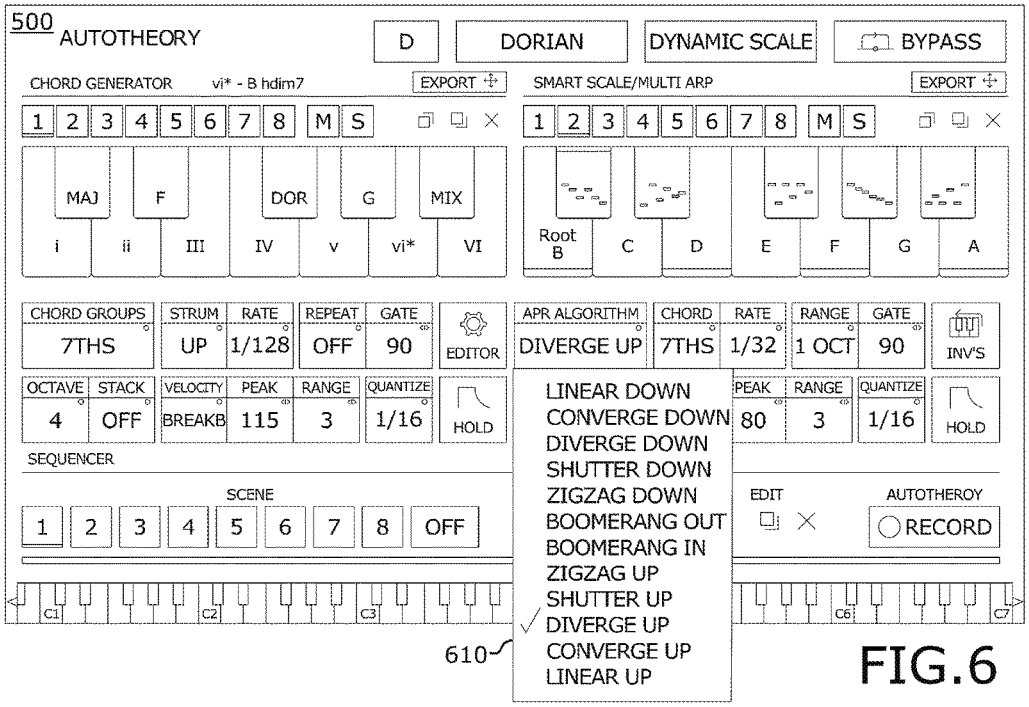
FIG. 6 conceptually illustrates a change in the arpeggio algorithm in the detailed UI of the multiple chord and arpeggio triggering MIDI mapping software application during the third stage of the MIDI mapping process for multiple chord and arpeggio triggering.

Now by way example and reference to FIG. 5, which conceptually illustrates a detailed user interface (UI) of the multiple chord and arpeggio triggering MIDI mapping software application 500 with highlighted selections in response to the user's chord selection and arpeggio selection as shown in the second stage 320 of the MIDI mapping process for multiple chord and arpeggio triggering. As shown in this figure, the chord generator section 440 and the multi-arpeggio section 450 are displayed in the UI and available for the user to make selections or otherwise conduct interactive engagement with the UI. Furthermore, the UI includes an arpeggio parameter settings section 510 with several configurable parameter settings that allow the user to define different and unique patterns for any given chord selection. As shown in this figure, the arpeggio parameter settings include a "Linear Up" arpeggio algorithm and a ⅛ rate, among several other arpeggio parameter settings.

Returning again to FIG. 3, the third stage 330 demonstrates a change in the arpeggio algorithm in the UI of the multiple chord and arpeggio triggering MIDI mapping software application. This is shown in more detail in FIG. 6, which conceptually illustrates the change in the arpeggio algorithm 610 (from "Linear Up" to "Diverge Up") in the detailed UI of the multiple chord and arpeggio triggering MIDI mapping software application 500. In addition, the change the arpeggio algorithm 610 (from "Linear Up" to "Diverge Up"), the rate has changed from ⅛ to 1/32. Thus, as can be seen from this example, a user has diverse and expansive control over any selected arpeggio among a plurality of arpeggios associated with a particular chord selection. Furthermore, this is all easily driven by simple user selections—one key selection for chord selection, and another key selection for arpeggio.

Now referring back to FIG. 3, the fourth stage 340 demonstrates output from the UI of the multiple chord and arpeggio triggering MIDI mapping software application to a digital audio workstation (DAW) user interface (UI). In this way, the user is able to map keys from a physical MIDI keyboard (or MIDI controller of another sort) to the multiple chord and arpeggio triggering MIDI mapping software application and easily make changes and alterations while creating music or patterns in the DAW software, thereby providing the user with tremendous creative control over chord(s) and multiple arpeggios of the chord(s) at the tips of the user's fingers.

Figure 7:
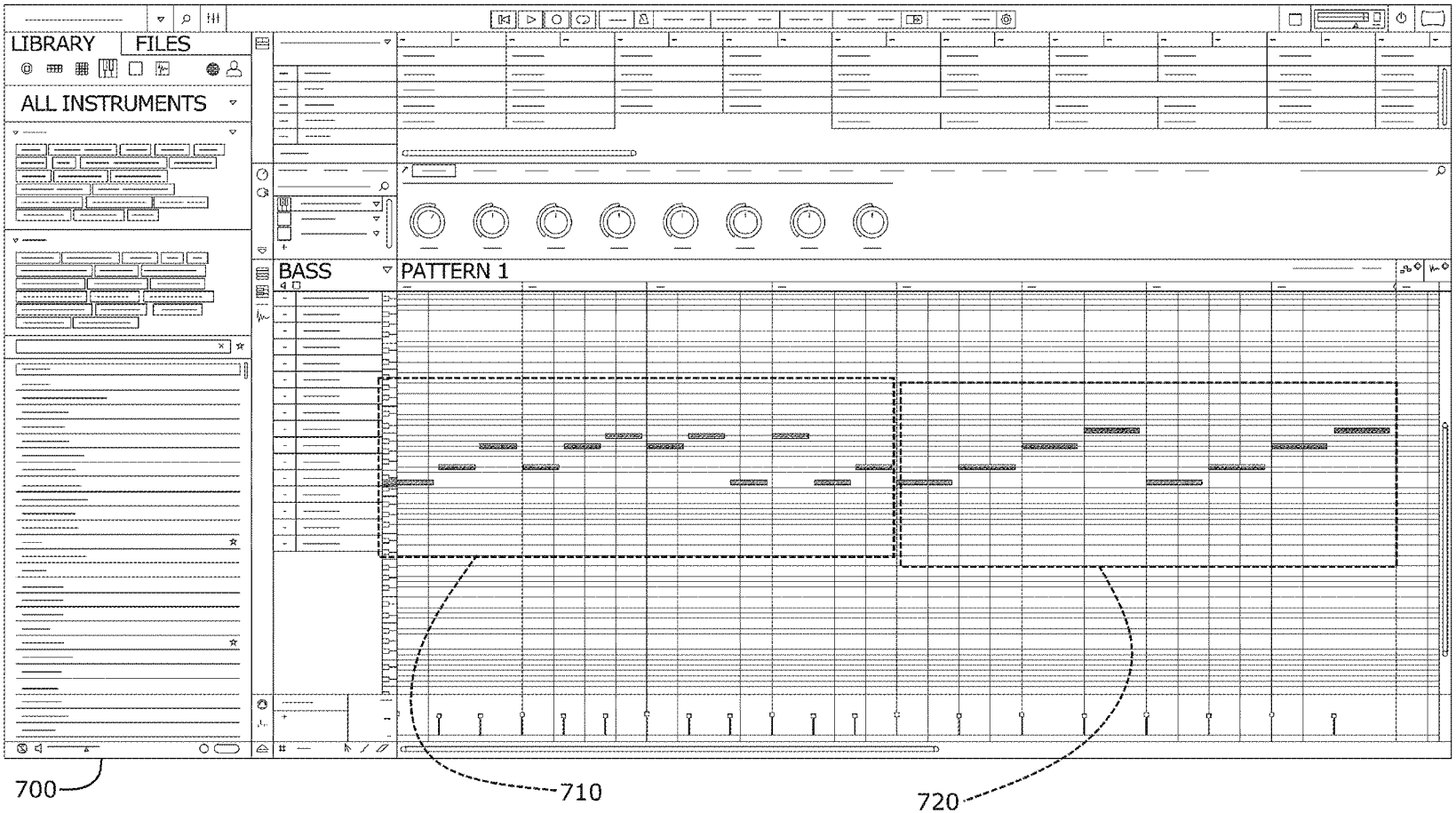
FIG. 7 conceptually illustrates a digital audio workstation (DAW) user interface (UI) that shows output from the multiple chord and arpeggio triggering MIDI mapping software application during a first time sequence associated with a first arpeggio algorithm parameter setting and during a second subsequent time sequence when the first arpeggio algorithm parameter setting is changed from the first arpeggio algorithm parameter setting to a second, different arpeggio algorithm parameter setting.

This is creative control is further demonstrated by reference to FIG. 7, which conceptually illustrates a digital audio workstation (DAW) user interface (UI) 700 (hereinafter also referred to as "DAW UI 700") with output from the multiple chord and arpeggio triggering MIDI mapping software application during a first time sequence 710 associated with a first arpeggio algorithm parameter setting ("Linear Up") and during a second subsequent time sequence 720 when the first arpeggio algorithm parameter setting ("Linear Up") is changed to a second, different arpeggio algorithm parameter setting ("Diverge Up").

The examples and description above focus primarily on MIDI, MIDI data, MIDI keyboards, and/or MIDI controllers. While MIDI (as a standard) is currently the predominant medium for synthesizer and sampler (individual samples of each tone from an instrument) based music production and playback, the mechanical processes described above could apply to any form of keyboard/software/sample playback. While the process describes using a keyboard controller to deliver the MIDI to the multiple chord and arpeggio triggering MIDI mapping software application, the MIDI could also be delivered by a pad or other type of MIDI controller which organizes tones in the same or similar manner as a keyboard. Such MIDI controllers could also self contain the multiple chord and arpeggio triggering MIDI mapping software application internally, as an embedded module or plug-in application. As such, some embodiments of the multiple chord and arpeggio triggering MIDI mapping system and process can be adapted for use in helping users to create musical compositions.

The above-described embodiments of the multiple chord and arpeggio triggering MIDI mapping system and the multiple chord and arpeggio triggering MIDI mapping process are presented for purposes of illustration and not of limitation. While these embodiments of the multiple chord and arpeggio triggering MIDI mapping system and the multiple chord and arpeggio triggering MIDI mapping process have been described with reference to numerous specific details, one of ordinary skill in the art will recognize that either of the multiple chord and arpeggio triggering MIDI mapping system or the multiple chord and arpeggio triggering MIDI mapping process can be embodied in other specific forms without departing from the spirit of the invention. For instance, the multiple chord and arpeggio triggering MIDI mapping system can be implemented as software, such as the subject multiple chord and arpeggio triggering MIDI mapping software application. However, it is also noted that embodiments of the multiple chord and arpeggio triggering MIDI mapping system and/or the multiple chord and arpeggio triggering MIDI mapping process can be implemented as other software application or programs that are either user-interactive software applications, embedded software, or modular software programs that can be plugged in or intergrated with other existing software applications, such as digital audio workstation (DAW) software or other audio processing software.

Many of the above-described features and applications are implemented as software (including the multiple chord and arpeggio triggering MIDI mapping software application) in which the software performs runtime software processes that are specified as a set of instructions recorded on a computer readable storage medium (also referred to as computer readable medium or machine readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, solid state devices (SSDs), EPROMs, etc. The computer readable media does not include carrier waves and electronic signals passing wirelessly or over wired connections.

III. Electronic System

Many of the above-described features and applications are implemented as software (including the multiple chord and arpeggio triggering MIDI mapping software application) in which the software performs runtime software processes that are specified as a set of instructions recorded on a computer readable storage medium (also referred to as computer readable medium or machine readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, solid state devices (SSDs), EPROMs, etc. The computer readable media does not include carrier waves and electronic signals passing wirelessly or over wired connections.

Figure 8:
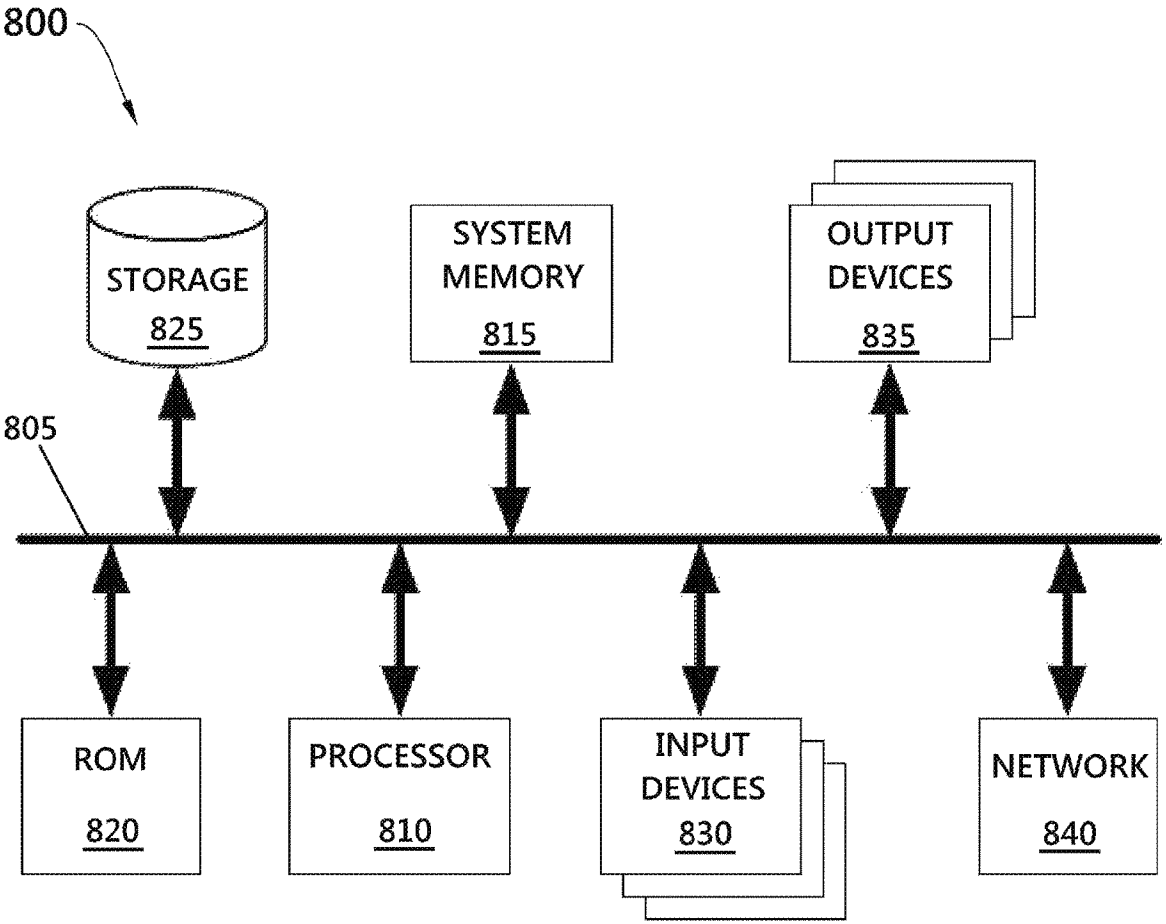
FIG. 8 conceptually illustrates an electronic system with which some embodiments of the invention are implemented.

FIG. 8 conceptually illustrates an electronic system 800 with which some embodiments of the invention are implemented. The electronic system 800 may be a computer, mobile device, tablet, phone, PDA, or any other sort of electronic device. Such an electronic system includes various types of computer readable media and interfaces for various other types of computer readable media. Electronic system 800 includes a bus 805, processing unit(s) 810, a system memory 815, a read-only 820, a permanent storage device 825, input devices 830, output devices 835, and a network 840.

The bus 805 collectively represents all system, peripheral, and chipset buses that communicatively connect the numerous internal devices of the electronic system 800. For instance, the bus 805 communicatively connects the processing unit(s) 810 with the read-only 820, the system memory 815, and the permanent storage device 825.

From these various memory units, the processing unit(s) 810 retrieves instructions to execute and data to process in order to execute the processes of the invention. The processing unit(s) may be a single processor or a multi-core processor in different embodiments.

The read-only-memory (ROM) 820 stores static data and instructions that are needed by the processing unit(s) 810 and other modules of the electronic system. The permanent storage device 825, on the other hand, is a read-and-write memory device. This device is a non-volatile memory unit that stores instructions and data even when the electronic system 800 is off. Some embodiments of the invention use a mass-storage device (such as a magnetic or optical disk and its corresponding disk drive) as the permanent storage device 825.

Other embodiments use a removable storage device (such as a floppy disk or a flash drive) as the permanent storage device 825. Like the permanent storage device 825, the system memory 815 is a read-and-write memory device. However, unlike storage device 825, the system memory 815 is a volatile read-and-write memory, such as a random access memory. The system memory 815 stores some of the instructions and data that the processor needs at runtime. In some embodiments, the invention's processes are stored in the system memory 815, the permanent storage device 825, and/or the read-only 820. For example, the various memory units include instructions for processing appearance alterations of displayable characters in accordance with some embodiments. From these various memory units, the processing unit(s) 810 retrieves instructions to execute and data to process in order to execute the processes of some embodiments.

The bus 805 also connects to the input and output devices 830 and 835. The input devices enable the user to communicate information and select commands to the electronic system. The input devices 830 include alphanumeric keyboards and pointing devices (also called "cursor control devices"). The output devices 835 display images generated by the electronic system 800. The output devices 835 include printers and display devices, such as cathode ray tubes (CRT) or liquid crystal displays (LCD). Some embodiments include devices such as a touchscreen that functions as both input and output devices.

Finally, as shown in FIG. 8, bus 805 also couples electronic system 800 to a network 840 through a network adapter (not shown). In this manner, the computer can be a part of a network of computers (such as a local area network ("LAN"), a wide area network ("WAN"), or an intranet), or a network of networks (such as the Internet). Any or all components of electronic system 800 may be used in conjunction with the invention.

These functions described above can be implemented in digital electronic circuitry, in computer software, firmware or hardware. The techniques can be implemented using one or more computer program products. Programmable processors and computers can be packaged or included in mobile devices. The processes may be performed by one or more programmable processors and by one or more set of programmable logic circuitry. General and special purpose computing and storage devices can be interconnected through communication networks.

Some embodiments include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media may store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the invention has been described with reference to numerous specific details, one of ordinary skill in the art will recognize that the invention can be embodied in other specific forms without departing from the spirit of the invention. For instance, FIGS. 1 and 2 conceptually illustrate processes in which the specific operations of each process may not be performed in the exact order shown and described. Specific operations may not be performed in one continuous series of operations, and different specific operations may be performed in different embodiments. Furthermore, each process could be implemented using several sub-processes, or as part of a larger macro process. Thus, one of ordinary skill in the art would understand that the invention is not to be limited by the foregoing illustrative details, but rather is to be defined by the appended claims.

I claim:

1. A multiple chord and arpeggio triggering MIDI mapping process comprising:

receiving a user selection of a chord-mapped key from a chord generator section of a divided MIDI controller;

receiving a user selection of a particular key in a multi-arpeggio section of the divided MIDI controller;

receiving a selection of a parameter setting associated with a particular arpeggio among a plurality of arpeggios associated with a particular chord that is mapped to the chord-mapped key from the chord generator section of the divided MIDI controller, wherein the particular arpeggio is mapped to the particular key in the multi-arpeggio section of the divided MIDI controller; and adding the particular chord, the particular arpeggio, and the parameter setting associated with the particular arpeggio to a palette of different patterns exported to a digital audio workstation (DAW) software application.

2. The multiple chord and arpeggio triggering MIDI mapping process of claim 1, wherein the MIDI controller comprises a MIDI keyboard.

3. The multiple chord and arpeggio triggering MIDI mapping process of claim 2, wherein the chord generator section comprises a first set of physical keys of the MIDI keyboard.

4. The multiple chord and arpeggio triggering MIDI mapping process of claim 2, wherein the user selection of the particular key in the multi-arpeggio section of the divided MIDI controller provides access to configurable parameters of a particular arpeggio associated with the particular key.

5. The multiple chord and arpeggio triggering MIDI mapping process of claim 1, further comprising receiving user assignments of chord and multi-arpeggio functions to associate with at least one of samples and synthesizers in a digital audio workstation (DAW) software application.

6. The multiple chord and arpeggio triggering MIDI mapping process of claim 1, further comprising:

displaying a user interface (UI);

displaying a UI-chord-generator section in the UI;

displaying a UI-multi-arpeggio section in the UI;

displaying, in response to the user selection of the chord-mapped key from the chord generator section of a divided MIDI controller, a corresponding chord-mapped UI key in the UI-chord-generator section of the UI; and displaying, in response to the user selection of a particular key in the multi-arpeggio section of the divided MIDI controller, a particular corresponding unique arpeggio-mapped UI key in the UI-multi-arpeggio section of the UI.

7. The multiple chord and arpeggio triggering MIDI mapping process of claim 1, further comprising displaying a plurality of parameter settings associated with the particular arpeggio.

8. The multiple chord and arpeggio triggering MIDI mapping process of claim 7, wherein the parameter setting is a particular selected parameter setting among the plurality of parameter settings associated with the particular arpeggio.

9. The multiple chord and arpeggio triggering MIDI mapping process of claim 8, wherein adding the particular chord, the particular arpeggio, and the parameter setting further comprises adding the plurality of parameter settings associated with the particular arpeggio to the palette of different patterns exported to the DAW software application.

10. The multiple chord and arpeggio triggering MIDI mapping process of claim 7, further comprising receiving a change of an arpeggio algorithm parameter setting from the plurality of parameter settings associated with the particular arpeggio, wherein adding the particular chord, the particular arpeggio, and the parameter setting further comprises adding the change of the arpeggio algorithm parameter setting to the palette of different patterns exported to the DAW software application.

11. The multiple chord and arpeggio triggering MIDI mapping process of claim 2, wherein the multi-arpeggio section comprises a second set of physical keys of the MIDI keyboard.

* * * * *